US005572219A

United States Patent [19]

Silverstein et al.

[11] Patent Number: 5,572,219

[45] Date of Patent: Nov. 5, 1996

[54] METHOD AND APPARATUS FOR REMOTELY CALIBRATING A PHASED ARRAY SYSTEM USED FOR SATELLITE COMMUNICATION

[75] Inventors: Seth D. Silverstein; Robert L. Nevin, both of Schenectady; William E. Engeler, Scotia, all of N.Y.

[73] Assignee: General Electric Company, Schenectady, N.Y.

[21] Appl. No.: 499,528

[22] Filed: Jul. 7, 1995

[51] Int. Cl.[6] ..... H01Q 3/22

[52] U.S. Cl. ..... 342/375; 342/174; 342/165

[58] Field of Search ..... 342/165, 174, 342/173, 194, 442, 375

[56] References Cited

U.S. PATENT DOCUMENTS

| | | | |
|---|---|---|---|
| 3,471,855 | 10/1969 | Thompson | 343/17.7 |
| 4,359,732 | 11/1982 | Martin | 343/5 CM |
| 4,538,150 | 8/1985 | Bone | 343/17.7 |
| 4,994,810 | 2/1991 | Sinsky | 342/151 |
| 5,081,460 | 1/1992 | Liu . | |
| 5,111,208 | 5/1992 | Lopez | 342/174 |
| 5,175,556 | 12/1992 | Berkowitz . | |
| 5,339,182 | 8/1994 | Kimble et al. | 359/112 |
| 5,379,320 | 1/1995 | Fernandes et al. | 375/1 |
| 5,412,414 | 5/1995 | Ast et al. | 342/174 |

FOREIGN PATENT DOCUMENTS 0414534 8/1990 European Pat. Off. .

OTHER PUBLICATIONS

"Orthogonal Transformations" by H. Andrews and K. Caspari, Computer Techniques in Image Processing, 1970, pp. 73–103.

"Two-Dimensional Discrete Fourier Transform" by V. Oppenheim and R. W. Schafer, Digital Signal Processing, pp. 115–121.

"DSCS III Receive Multiple Beam Antenna Performance Improvement", Y. P. Loh, R. T. Goalwin, National Telesystems Conference, Mar. 26 & 27, 1991, World Congress Center, Atlanta, Georgia.

"On-Orbit Performance Tests of DSCS III Receive MBA", R. T. Goalwin, R. A. Williams, L. D. Graham, Y. P. Loh, Mar. 19, 1990, pp. 1–4.

"Performance Limitations and Improvement Scheme for DSCS III Receive Multiple Beam Antenna" by Y. P. Loh, Mar. 7, 1990, pp. 1–4.

"Hadamard Transform Imaging Coding" by W. K. Pratt, J. Kane, H. C. Andrews, Proceedings of the IEEE, vol. 57, No. 1, Jan. 1969, pp. 58–68.

"A Large Deployable Active Phased Array Antenna for Satellite Use", T. Katagi, Y. Konishi, Y. Tamai, Y. Iida, Mitsubishi Electric Corp., Proceedings of the 15th AIAA International Communications Satellite Systems. Conf., San Diego, CA, Feb. 28–Mar. 3, 1994, pp. 1075–1083.

(List continued on next page.)

*Primary Examiner*—Thomas H. Tarcza
*Assistant Examiner*—Dao L. Phan
*Attorney, Agent, or Firm*—Marvin Snyder

[57] ABSTRACT

A method and apparatus for remotely calibrating a system having a plurality of N elements, such as a phased array system, is provided. The method includes generating coherent signals, such as a calibration signal and a reference signal having a predetermined spectral relationship between one another. The calibration signal which is applied to each respective one of the plurality of N elements can be orthogonally encoded based on the entries of a predetermined invertible encoding matrix, such as a binary Hadamard matrix, to generate first and second sets of orthogonally encoded signals. The first and second sets of orthogonally encoded signals and the reference signal are transmitted to a remote location. The transmitted first and second sets of orthogonally encoded signals are coherently detected at the remote location. The coherently detected first and second sets of orthogonally encoded signals are then decoded using the inverse of the predetermined invertible encoding matrix to generate a set of decoded signals. The set of decoded signals is then processed for generating calibration data for each element of the system.

30 Claims, 8 Drawing Sheets

OTHER PUBLICATIONS

"A Built–In Performance–Monitoring/Fault Isolation and Correction (PM/FIC) System for Active Phased–Array Antennas", M. Lee, R.–S.–C. Liu, Hughes Aircraft Company, IEEE Trans. on Antennas and Propagation, vol. 41–11, ov. 1993, pp. 1530–1540.

U.S. patent application entitled "A Method and Apparatus For Remotely Calibrating A Phased Array System Used for Satellite Communication Using a Unitary Transform Encoder" (Attorney Docket No. RD–24492) Seth D. Silverstein et al.

"Far Fiaeld Alignment and Testing of Passive Phased Array Antennas" by H. E. Schrank, Westinghouse Electronic Corp. Baltimore, Maryland, pp. 1–9.

"Computer–Aided Fault Determination for an Advanced Phased Array Antenna" by D. K. Alexander, R. P. Gray, Jr., Sep. 26–28, 1979 for 1979 Antenna Applications Symposium, Urbana, Ill. pp. 1–13.

"Phased Array Alignment and Calibration Techniques", James M. Howell, Workshop on Testing Phased Arrays and Diagnostics, Jun. 30, 1989.

METHOD AND APPARATUS FOR REMOTELY CALIBRATING A PHASED ARRAY SYSTEM USED FOR SATELLITE COMMUNICATION

BACKGROUND OF THE INVENTION

Active phased array systems or smart antenna systems have the capability for performing programmable changes in the complex gain (amplitude and phase) of the, elemental signals that are transmitted and/or received by each respective element of the phased array system to accommodate different beam-forming scenarios. Communications satellites equipped with phased array systems are desirable since satellites so equipped have an intrinsic performance advantage over satellites with conventional reflector antennas. For example, a communications satellite with a phased array system can offer the following advantages: reconfigurable beam patterns ranging from broad-uniform continental coverage down to narrow spot beam patterns with 3 dB widths of about 1°; flexibility in varying the level of effective isotropic radiated power (EIRP) in multiple communication channels; and means for providing graceful system performance degradation to compensate for component failures. As conditions for the phased array system in the satellite can change in an unpredictable manner, regularly scheduled calibration for characteristics of the system, such as phase and amplitude characteristics, is generally required to assure optimal system performance.

In order to obtain meaningful estimates of the respective complex gains for the elemental signals respectively formed in each element of the phased array system, the calibration process must be performed in a time window that is sufficiently short so that the complex gains for the respective elemental signals transmitted from each element are substantially quasi-stationary. For a typical geostationary satellite application, the relevant time windows are dominated by two temporally variable effects: changes in the transmitted elemental signals due to variable atmospheric conditions encountered when such signals propagate toward a suitable control station located on Earth; and changes in the relative phase of the transmitted elemental signals due to thermally induced effects in the satellite, such as phase offsets in the respective circuit components for each respective element of the phased array system, and physical warpage of a panel structure employed for supporting the phased array. The thermally induced effects are caused primarily by diurnal variations of the solar irradiance on the phased array panel.

Calibration techniques proposed heretofore are essentially variations on the theme of individually measuring, one at a time, the respective complex gain of each single element (SE) of the phased array system while all the other elements of the phased array system are turned off. Although these calibration techniques (herein referred as SE calibration techniques) are conceptually simple, these SE calibration techniques unfortunately have some fundamental problems that make their usefulness questionable for meeting the calibration requirements of typical phased array systems for communications satellites. One problem is the difficulty of implementing a multipole microwave switching device coupled at the front end of the respective electrical paths for each elemental signal so as to direct or route suitable test signals to any single element undergoing calibration. This multipole switching device is typically necessary in the SE calibration techniques to measure the complex gain for the elemental signal respectively formed in any individual element undergoing calibration at any given time. Another problem of the SE calibration techniques is their relatively low signal-to-noise ratio (SNR). This effectively translates into relatively long measurement integration times. At practical satellite power levels, the integration times required to extract the calibration measurements for the SE calibration techniques are often too long to satisfy the quasi-stationarity time window criteria described above. In principle, one could increase the effective SNR of the SE process by increasing the power of the calibration signals transmitted from each element. However, as each element of the phased array system is usually designed to operate at near maximum power, as dictated by the power-handling capacity and linearity constraints for the circuit components in each element, it follows that arbitrary additional increases in power levels are typically not feasible. Thus it is desirable to provide a calibration method that allows for overcoming the problems associated with SE calibration techniques.

SUMMARY OF THE INVENTION

Generally speaking, the present invention fulfills the foregoing needs by providing a method and apparatus for remotely calibrating a system having a plurality of N elements, N being a positive integer number. The method includes generating coherent signals, such as a calibration signal and a reference signal having a predetermined spectral relationship between one another. The calibration signal which is applied to each respective one of the plurality of N elements can be orthogonally encoded based on the entries of a predetermined invertible encoding matrix, such as a binary Hadamard matrix, to generate first and second sets of orthogonally encoded signals. The first and second sets of encoded signals and the reference signal are transmitted to a remote location. The transmitted first and second sets of encoded signals are coherently detected at the remote location. The coherently detected first and second sets of encoded signals are then decoded using the inverse of the predetermined invertible encoding matrix to generate a set of decoded signals. The set of decoded signals is then processed for generating calibration data for each element of the system.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following detailed description in conjunction with the accompanying drawings in which like numerals represent like parts throughout the drawings, and in which:

DETAILED DESCRIPTION OF THE INVENTION

Figure 1:
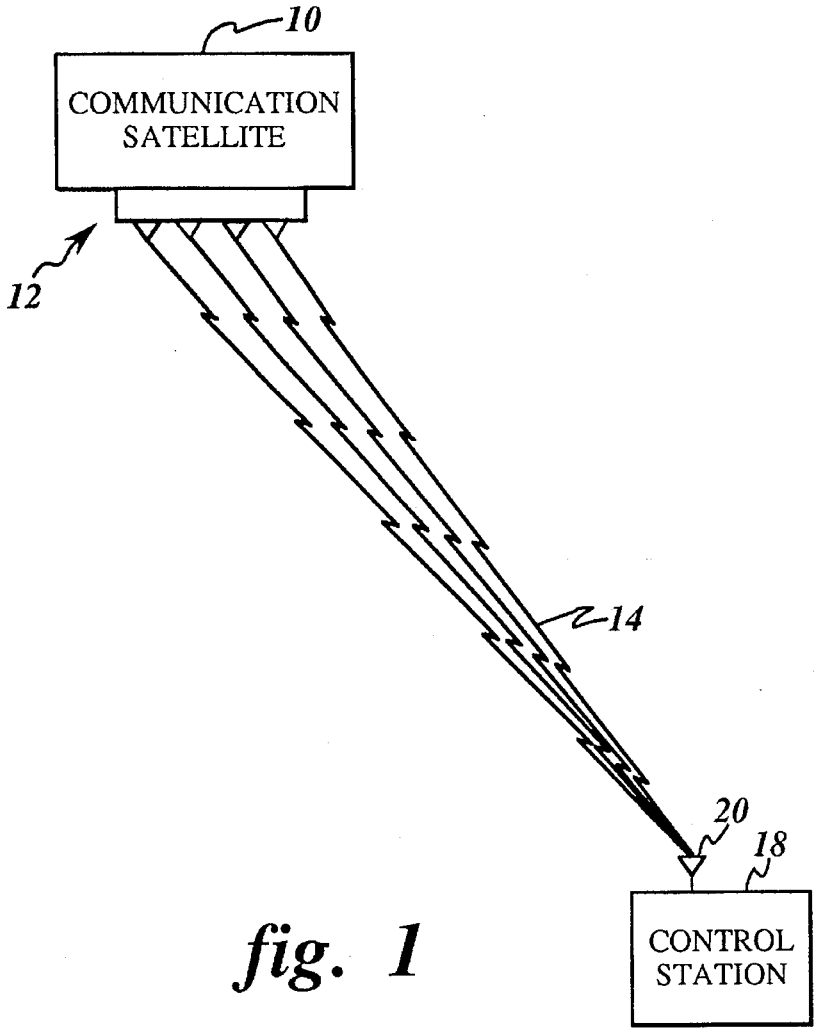
FIG. 1 is a simplified block diagram representation of a communications satellite using a phased array system that can be remotely calibrated in accordance with the present invention from a remote control station.

FIG. 1 illustrates a communications satellite 10 that incorporates a phased array system 12 for transmitting and/or receiving radio frequency (RF) signals 14. If, for example, phased array system 12 is used in a transmitting mode, then RF signals 14 can be received at a remote control station 18, such as an earth-based control station, through a receiving antenna 20. As will be appreciated by those skilled in the art, a phased array system operates on the principle that the phase of the RF signals emitted from the elements of the array can be selectively adjusted to provide a desired interference pattern at locations that are spatially remote from each element of the phased array. Consider an RF transmission from an N-element phased array system at wavelength $\lambda$. By way of example, choose a coordinate system with its origin at the center of the phased array. The signals $A(\vec{R}_i)$, received at spatial points $\vec{R}_i$, are the interference sum of N elemental signals, $$A(\vec{R}_i) = K_i \sum_{n=1}^{N} a(n)s(n,\vec{R}_i), \tag{1}$$

having waveforms $s(n,\vec{R}_i)$, such that $$s(n,\vec{R}_i) \propto \frac{e^{j2\pi|\vec{R}_i-\vec{r}_n|/\lambda}}{|\vec{R}_i-\vec{r}_n|} \xrightarrow{\text{far field}} \frac{e^{j2\pi|\vec{R}_i|/\lambda}}{|\vec{R}_i|} e^{-j2\pi\vec{r}_n\cdot\vec{R}_i/(\lambda|\vec{R}_i|)}. \tag{2}$$

Figure 2:
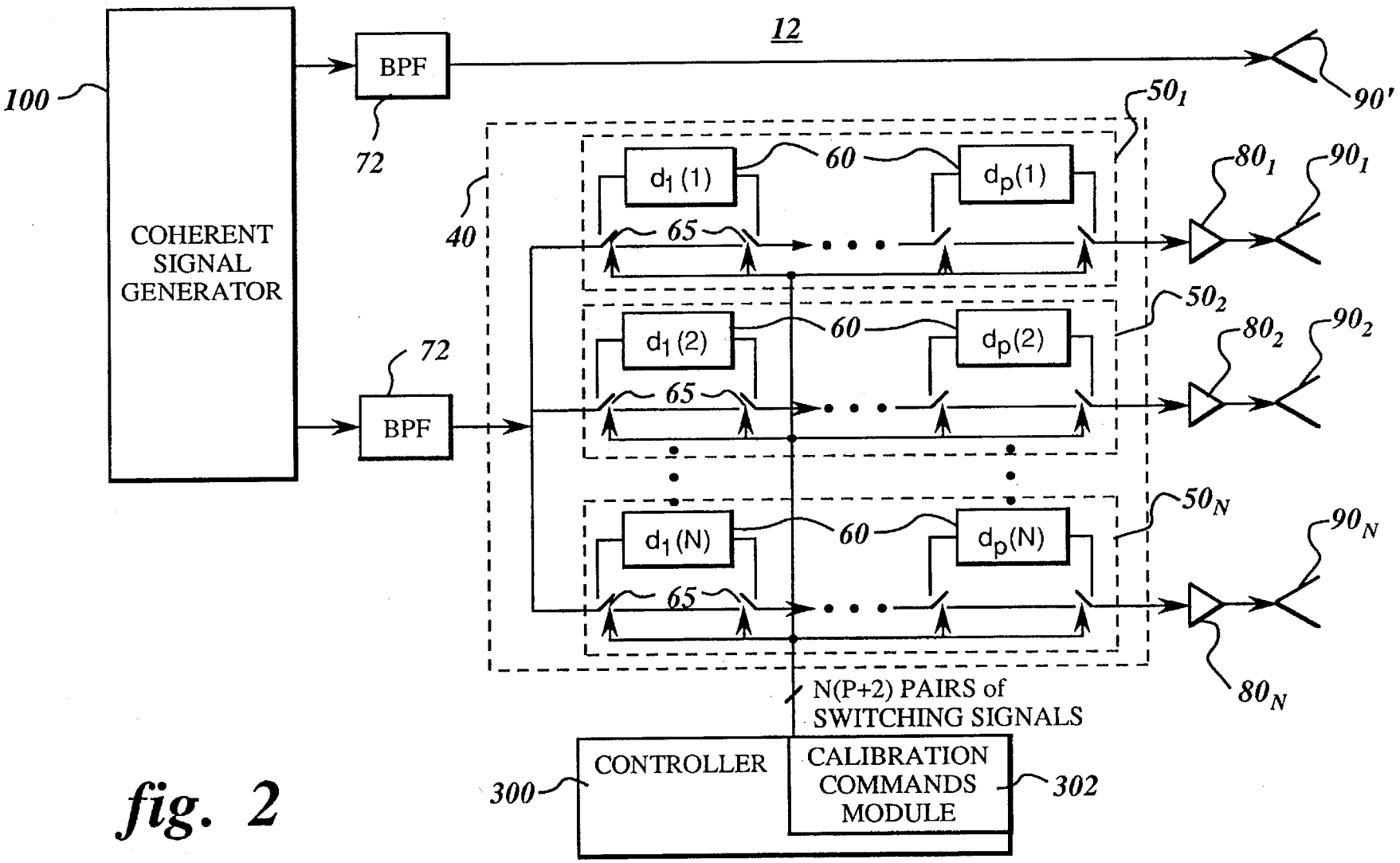
FIG. 2 is a block diagram representation showing an exemplary architecture for the phased array system of FIG. 1, and including a coherent signal generator and a controller for controllably switching respective delay circuits in each element of the phased array system in accordance with one embodiment for the present invention.

The relative values of the set of coefficients, {a(n)}, give the relative complex gains associated with respective circuit components, such as phase shifters 50 (FIG. 2) and power amplifiers 80 (FIG. 2), for each element of the phased array. It can be shown that information merely obtained by spatially sampling any interference pattern transmitted and/or received by the phased array (but not encoded in accordance with the present invention) cannot easily extract phase offsets due to the relative positioning of the elemental horns of the phased array, such as transmitting horns 90 (FIG. 2). In principle, the value for each coefficient a(n) could be determined by measuring or sampling the amplitude and phase of the interference pattern at N distinct spatial sampling locations $\{\vec{R}_i\}$; i=1, 2, . . . , N, that are specifically selected to provide N linearly independent simultaneous equations. In practice this procedure would be very difficult to implement as N values of three different parameters would have to be known to compute a solution. The three different parameters include the spatial sampling $\{\vec{R}_i\}$, the elemental transmitting horn positions $\vec{r}_n$, and the relative values of the different propagation constants $K_i$.

In contrast to the above-described spatial sampling calibration technique, coherent signal encoding of the elemental signals provides a dramatic simplification as the encoded signals, which enable to form predetermined time multiplexed beam patterns, can be received at a single receiver point situated along a reference direction $\vec{R}_0$. Further, as there is only one propagation constant $K_0$, its value need not be known to determine the respective relative values of each complex gain. Also, in the far field, the parameters of interest can be obtained without knowledge of the distance to the single receiver point. It is assumed that the projection angle of reference direction $\vec{R}_0$ onto the uniform phase plane of the array is known to a precision commensurate with the desired calibration accuracy. As will be appreciated by those skilled in the art, the projection angle can be measured using readily available attitude measurements from conventional celestial body sensors, such as Earth, Moon and Sun sensors.

In the far field, the received signal of any mth coherently encoded transmission is of the form, $$A(m,\vec{R}_0) = K_0 \frac{e^{j2\pi\vec{R}_0/\lambda}}{\vec{R}_0} \sum_{n=1}^{N} t(m,n)a(n)e^{-j2\pi\vec{r}_n\cdot\vec{R}_0/(\lambda\vec{R}_0)}, \tag{3}$$

for $m = 1, 2, \ldots, N$.

If t(m,n) represents the coefficients of a predetermined invertible, encoding matrix T, such as an unitary, encoding matrix, then the respective relative values of the product $\{a(n)e^{-j2\pi\vec{r}_n\cdot\vec{R}_0/(\lambda\vec{R}_0)}\}$ can be obtained directly from the inversion of matrix T which enables for solving a system of N linearly independent simultaneous equations. In general, the inverse of a unitary matrix U is equal to the Hermitian conjugate U* of the matrix U and thus $U^{-1} \equiv U^*$. As will be appreciated by those skilled in the art, the rows and columns of a unitary matrix, such as matrix U, form a complete orthonormal set of basis vectors that span the vector space upon which matrix U is defined. In general, orthogonal transforms are formally defined as the subset of unitary transformations defined on real vector spaces. Orthogonal transforms have been used extensively in imaging applications; see, for example, technical paper by W. K. Pratt, J. Kane, and H. C. Andrews, "Hadamard Transform Image Coding", Proc. IEEE 57, No. 1, at 58–68, (January 1969). As used herein the matrix T differs from its associated unitary matrix by a normalization factor $\sqrt{N}$. Accordingly, T is referred as a renormalized unitary matrix, $$T \equiv \sqrt{N}\ T, \Rightarrow T^{-1} = \frac{1}{N}\ T^*. \tag{4}$$

By way of example and not of limitation, it can be shown that a minimum variance encoding scheme can be achieved when using a renormalized unitary matrix where each matrix element has unit magnitude, i.e., |t(m,n)|=1. Some notable examples of equal magnitude renormalized unitary matrices are the classes of two-dimensional (2D) discrete Fourier transforms (DFT) and Hadamard matrices.

FIG. 2 shows a simplified schematic of an exemplary analog architecture for an N-element phased array system 12. It will be appreciated that the present invention need not be limited to analog architectures being that digital beamforming architectures can readily benefit from the teachings of the present invention. It will be further appreciated that the present invention need not be limited to a phased array system being that any system that employs coherent signals, such as coherent electromagnetic signals employed in radar, lidar, communications systems and the like; or coherent sound signals employed in sonar, ultrasound systems and the like, can readily benefit from the teachings of the present invention.

Phased array system 12 includes a beam-forming matrix 40 made up of N phase shifters $\mathbf{50}_1$–$\mathbf{50}_N$ each having a p-bit beam-forming capability. Each respective phase shifter for each element is made up of p independent delay circuits 60 that, by way of suitable switches 65, can be selectively switched or actuated into the electrical path for each elemental signal to provide $2^p$ quantized phase levels corresponding to phase shifts of $2\pi m/2^p$ for m=0, 1, . . . , $2^p-1$. FIG. 2 further shows a coherent signal generator 100 that supplies a reference tone or signal having a predetermined spectral relationship with respect to a calibration signal applied to each element of the phased array. For example, the reference signal can be offset in frequency by a predetermined factor from the calibration signal. The reference signal and the calibration signal each passes through respective bandpass filters 72 having a predetermined passband substantially centered about the respective frequencies for the reference signal and the calibration signal. Although in FIG. 2 coherent signal generator 100 is shown as supplying one reference signal, it will be appreciated that additional reference signals, if desired, could be readily obtained from coherent signal generator 100.

As shown in FIG. 2, each phased array element further includes a respective power amplifier 80 and a respective horn 90. Although FIG. 2 shows that the reference signal is transmitted from a separate horn 90', the reference signal can, with equivalent results, be transmitted from any of the phased array elements as long as the reference signal is injected into the electrical path after any of the phase shifters $\mathbf{50}_1$–$\mathbf{50}_N$ so that the reference signal is unaffected by any encoding procedures performed by the phase shifters. FIG. 2 shows a controller 300 which, during normal operation of the system, can issue switching commands for forming any desired beam patterns.

In accordance with one preferred embodiment for the present invention, controller 300 further includes a calibration commands module 302 for issuing first and second sets of switching signals that allow the delay circuits 60 for encoding corresponding first and second sets of signals being transmitted by the N elements of the phased array system to a remote location, such as control station 18 (FIG. 1).

As suggested above, the controlled switching, i.e., the encoding, is dictated by the matrix elements or entries of a predetermined invertible, binary matrix. In particular, a class of orthogonal matrices, such as binary or bipolar Hadamard matrices, is optimal in the sense of providing minimal statistical variance for the estimated calibration parameters. The encoding matrix can be chosen to have a size N×N if N is an even number for which a Hadamard matrix can be constructed. If a Hadamard matrix of order N cannot be constructed, then the next higher order Hadamard construction can be conveniently used for the encoding. For example, the next higher order can be conveniently chosen as K=N+Q where Q is a positive integer number representing extra transmissions corresponding to non-existing elements and thus such extra transmissions are effectively treated as if they were made up of zero value signals. It will be appreciated by those skilled in the art that this matrix construction technique is analogous to "zero-filling" techniques used in a Fast Fourier transform, for example. Henceforth in our discussion for the sake of simplicity and not by way of limitation we will only consider Hadamard matrices, represented by H for the controlled switching (CS) procedure. It will be shown that upon performing suitable coherent detection and decoding at the remote location, the first and second sets of orthogonally encoded signals allow for determining calibration data indicative of any changes in the respective complex gains of the delay circuits, and including the respective signals {s(n) for n=1, 2, . . . , N} associated with each of the phased array elements when no delay circuit is switched-in, i.e., each signal associated with a respective undelayed or "straight-through" electrical path that includes the respective power amplifier and horn but does not include any delay circuit in any respective phased array element.

Figure 3A:
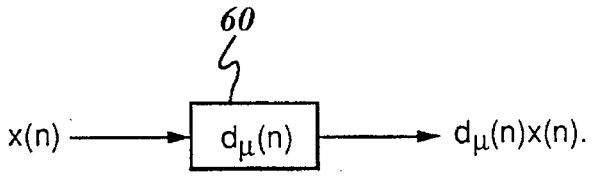
FIGS. 3*a* and 3*b* illustrate, respectively, gain characteristics for a single delay circuit being switched-in, and for multiple (two) delay circuits being switched-in in any given one of the elements of the phased array system of FIG. 2.
Figure 3B:
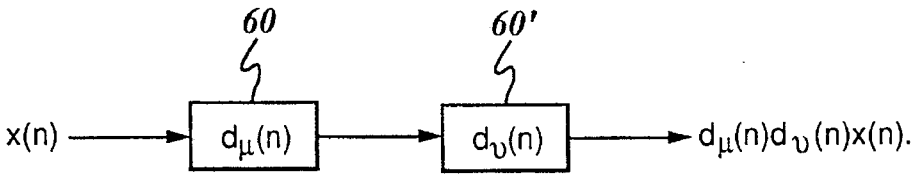

For an analog embodiment, it is assumed that the power levels for the calibration signal are low enough so that the phase shifters can be treated as linear microwave devices. For example, the effect of switching-in or actuating a single delay circuit 60, such as the μth delay circuit in any nth phase shifter with a complex gain dμ(n) simply imposes a complex gain as shown in FIG. 3*a* to an input signal x(n). The effect of switching-in or actuating multiple delay circuits 60 and 60' simply generates the product of the respective complex gains for the multiple circuits switched-in. For example, as shown in FIG. 3*b*, if the υth delay circuit for the nth phase shifter with a complex gain dv(n) is switched-in together with the μth delay circuit, then the complex gain for the input signal x(n) will be as shown in FIG. 3*b*.

Figure 4:
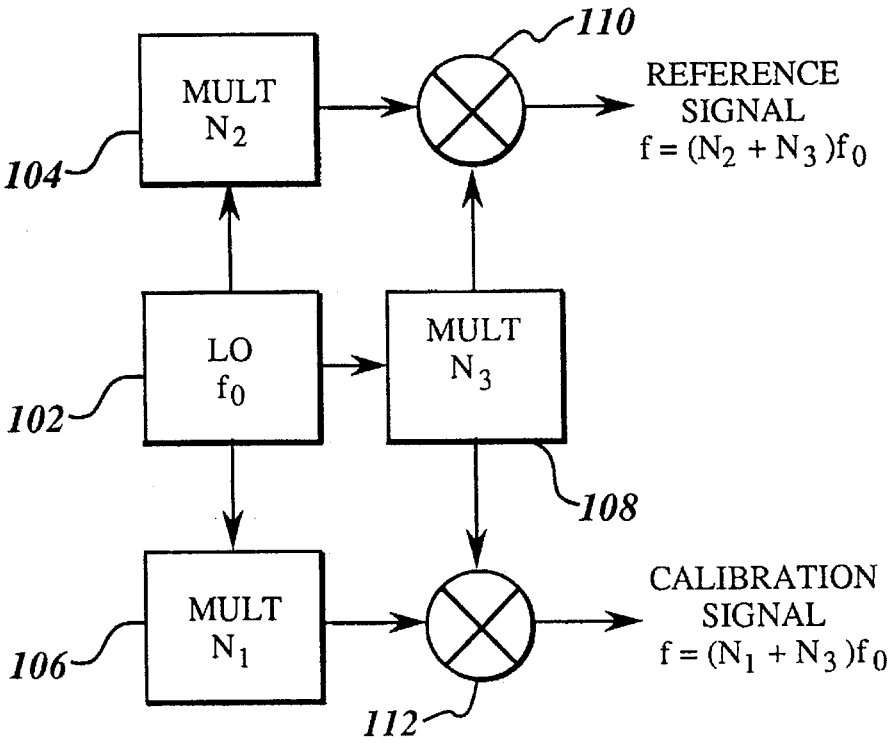
FIG. 4 shows further details about the coherent signal generator of FIG. 2.

FIG. 4 shows a simplified schematic for coherent signal generator 100 used for generating coherent signals, such as the calibration signal and the reference signal. As used herein the expression coherent signals refers to signals having a substantially constant relative phase relation between one another. As shown in FIG. 4, a local oscillator 102 supplies an oscillator output signal having a predetermined frequency $f_o$ to respective frequency multipliers 104, 106 and 108 each respectively multiplying the frequency of the oscillator output signal by a respective multiplying factor such as $N_1$, $N_2$ and $N_3$, respectively. As shown in FIG. 4, the respective output signals of multipliers 108 and 104 is mixed in a first mixer 110 to supply a first mixer output signal having a frequency $f=(N_2+N_3)f_o$. Similarly, the respective output signals of multipliers 106 and 108 are mixed in a second mixer 112 to supply a second mixer output signal having a frequency $f=(N_1+N_3)f_o$. By way of example, the first mixer output signal can constitute the reference signal and the second mixer output signal can constitute the calibrated signal applied to each element of the phased array system.

Figure 5:
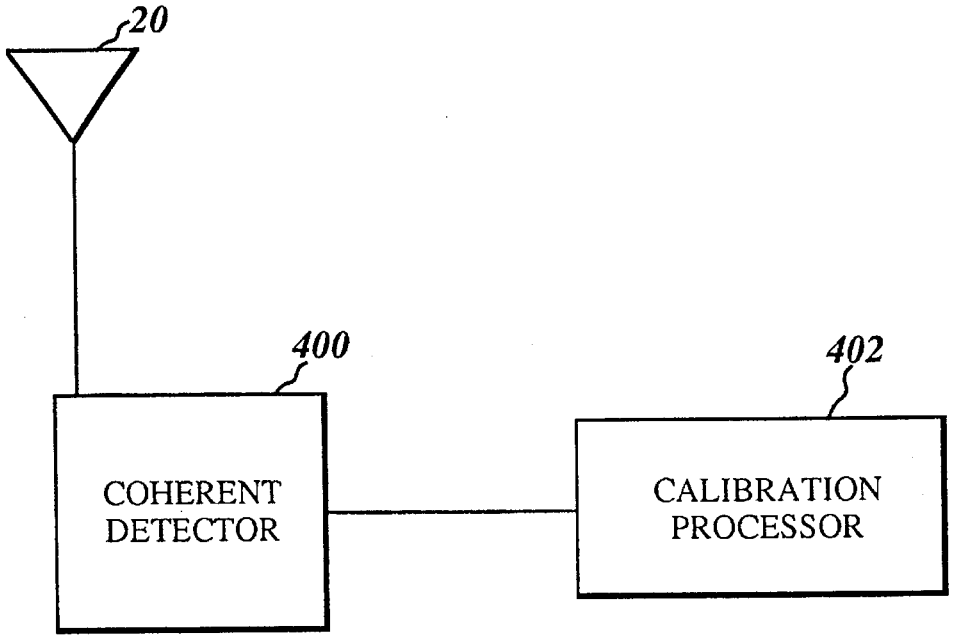
FIG. 5 is a simplified block diagram for a coherent detector and a calibration processor situated at the remote control station of FIG. 1.

FIG. 5 shows a simplified block diagram for a coherent detector 400 and a calibration processor 402 which can be situated at control station 18 (FIG. 1) for detecting and decoding, respectively, any sequences of encoded coherent signals being transmitted from the phased array system for determining calibration data which can then be conveniently "uplinked" to the satellite to compensate for changes in the various components which make up each respective element of the phased array system, such as power amplifiers, horns, and phase shifters.

Figure 6:
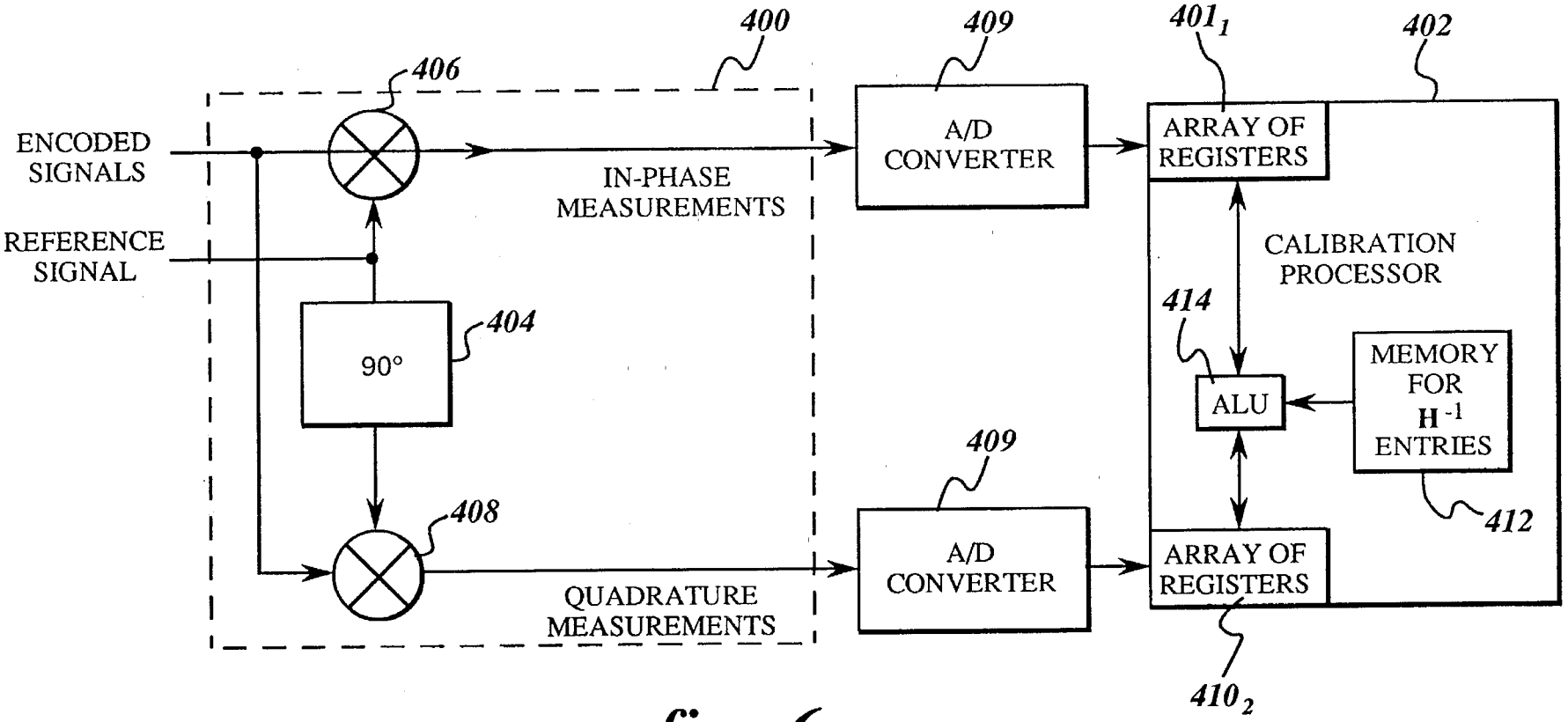
FIG. 6 shows further details about the coherent detector of FIG. 5.

FIG. 6 shows details about coherent detector 400 and calibration processor 402. As shown in FIG. 6, the received reference signal is supplied to a first mixer 406 and to a phase shifter 404, which imparts a phase shift of substantially 90° to the received coherent reference signal. As further shown in FIG. 6, each orthogonally encoded signal is supplied to first and second mixers 406 and 408, respectively. First mixer 406 mixes any received encoded signal with the reference signal to supply a first mixer output signal replicating the respective component of any received encoded signal that is in phase with the reference signal. Conversely, second mixer 408 mixes any received encoded signal with the phase shifted reference signal to supply a second mixer output signal replicating the respective component of any received encoded signal that is in quadrature (at 90°) with the reference signal. The in-phase and quadrature components are converted to digital data by respective analog-to-digital (A/D) converters 409. As shown in FIG. 6, calibration processor 402 can include register arrays $\mathbf{410}_1$ and $\mathbf{410}_2$ for storing, respectively, the in-phase components and the quadrature components supplied by A/D converters 409. Calibration processor 402 can further include a memory 412 that can store entries for the inverse matrix $H^{-1}$ which is used for decoding the respective quadrature components of the encoded signals. Calibration processor 402 further includes an arithmetic logic unit (ALU) 412 for performing any suitable computations used for decoding the respective quadrature components of the encoded signals. For example, ALU 412 can be used for computing a difference between each quadrature component for the first and second sets of orthogonally encoded signal, and computing the product of the resulting difference with the inverse matrix $H^{-1}$.

Figure 7:
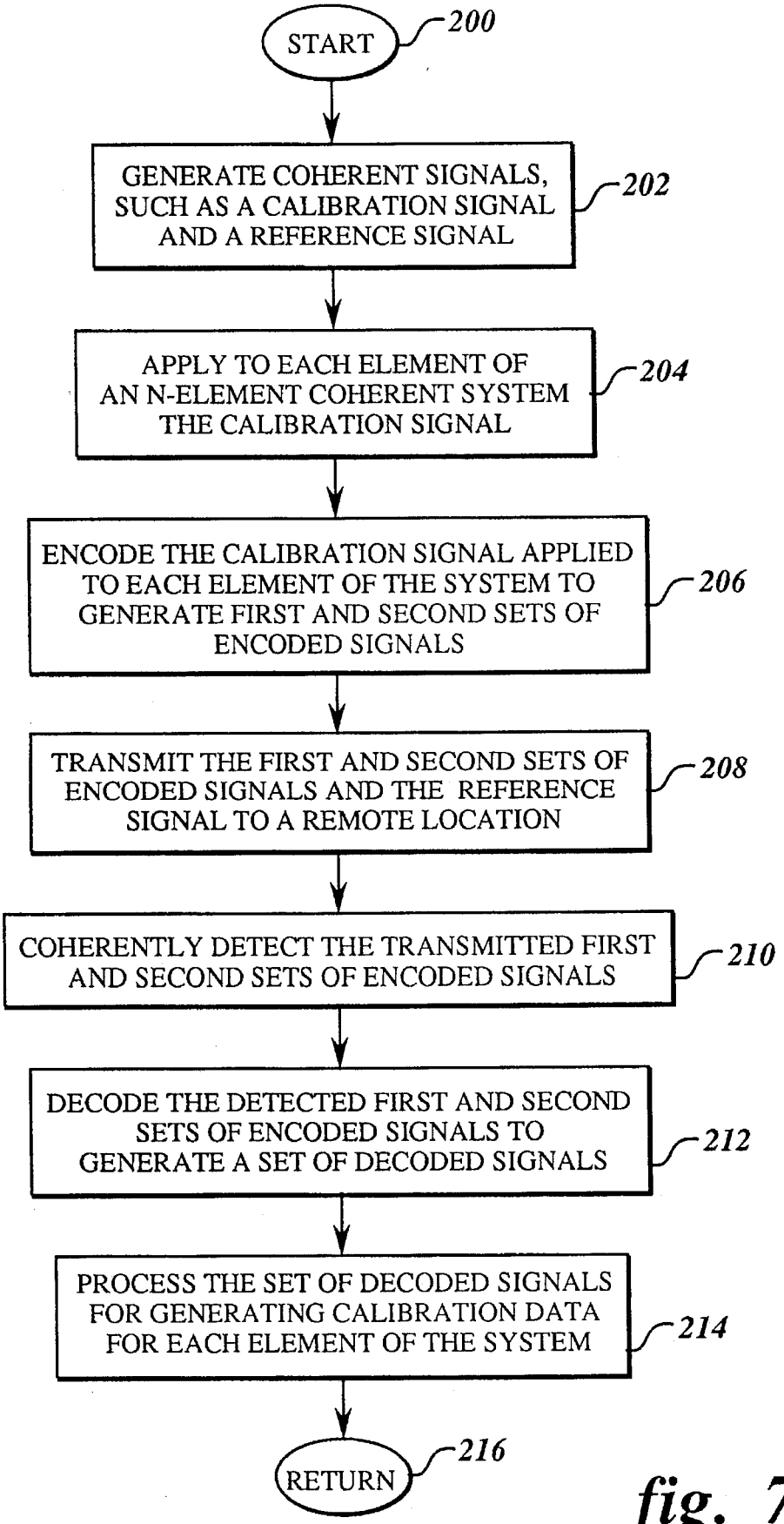
FIG. 7 is a flowchart of an exemplary embodiment for a calibration method in accordance with the present invention.

FIG. 7 shows a flow chart for an exemplary calibration method in accordance with the present invention. After start of operations in step 200, step 204 allows for generating coherent signals, such as the calibration signal and reference signal generated by coherent signal generator 100 (FIGS. 2 and 4). In accordance with step 204, the calibration signal is applied to each element of an N-element coherent system, such as the phased array system of FIG. 2. Step 206 allows for encoding the calibration signal applied to each element of the coherent system to generate, for example, first and second sets of encoded signals. The encoding can be advantageously performed using controlled switching or toggling of the delay circuits in each element of the phased array system, that is, no additional or separate encoding hardware is required being that the encoding is performed based on the specific delay circuits that are actuated in response to the switching signals from calibration commands module 110 (FIG. 2). For another preferred embodiment which uses a unitary transform encoder for orthogonally encoding the calibration signal applied to each element of the phased array system, the reader is referred to concurrently-filed U.S. patent application Ser. No. 8/499,796, entitled "A Method For Remotely Calibrating A Phased Array System Used For Satellite Communication Using A Unitary Transform Encoder", assigned to the same assignee of the present invention and herein incorporated by reference. Step 208 allows for transmitting the first and second sets of encoded signals and the reference signal to a remote location, such as control station 18 (FIG. 1). Step 210 allows for coherently detecting the transmitted first and second sets of encoded signals at the remote location. Step 212 allows for decoding the detected first and second sets of encoded signals to generate a set of decoded signals which can be conveniently processed in step 214, prior to end of operations in step 216, for generating calibration data for each element of the phased array system.

Figure 8:
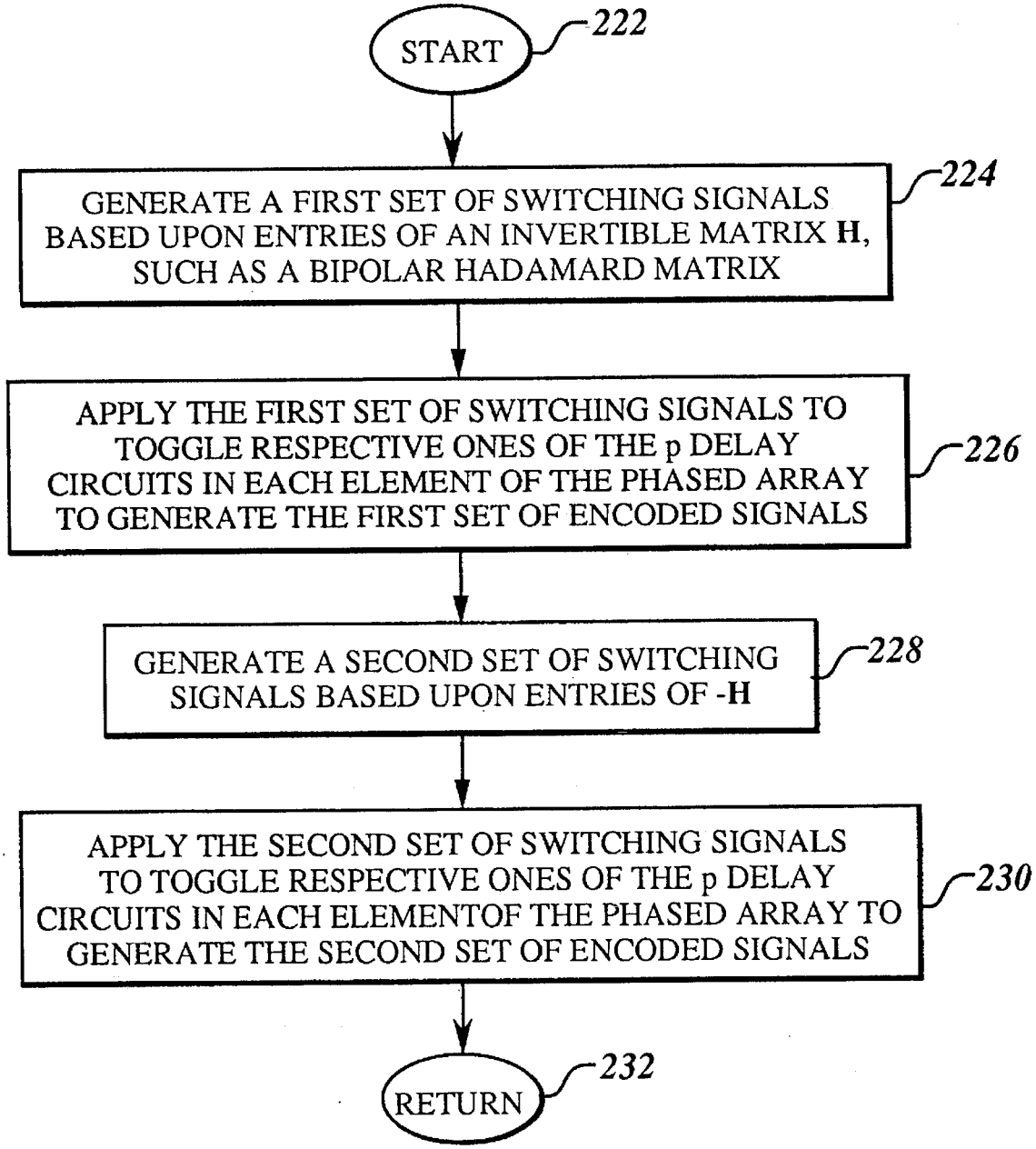
FIG. 8 is a flowchart showing steps used for orthogonally encoding signals in a coherent system, such as the phased array system of FIG. 2.

FIG. 8 shows a flow chart, which can be conveniently used for performing encoding step 206 (FIG. 7) in the phased array system of FIG. 2. After start of operations in step 222, step 224 allows for generating a first set of switching signals based upon entries of invertible, binary matrix H. Step 226 allows for applying the first set of switching signals to actuate respective ones of the p delay circuits in each element of the phased array system to generate the first set of encoded signals. In contrast, as shown in step 228, the second set of switching signals uses −H for the controlled switching which in turn generates the second set of encoded signals. Prior to end of operations in step 232, step 230 allows for applying the second set of switching signals to actuate respective ones of the p delay circuits in each element of the phased array to generate the second set of encoded signals. This switching procedure using a Hadamard control matrix effectively generates an exact unitary (orthogonal) transform encoding of the calibration signal applied to each of the phased array elements. As suggested above, this switching scheme is particularly advantageous being that the delay circuits themselves provide the desired encoding, and thus no additional encoding hardware is required.

Figure 9:
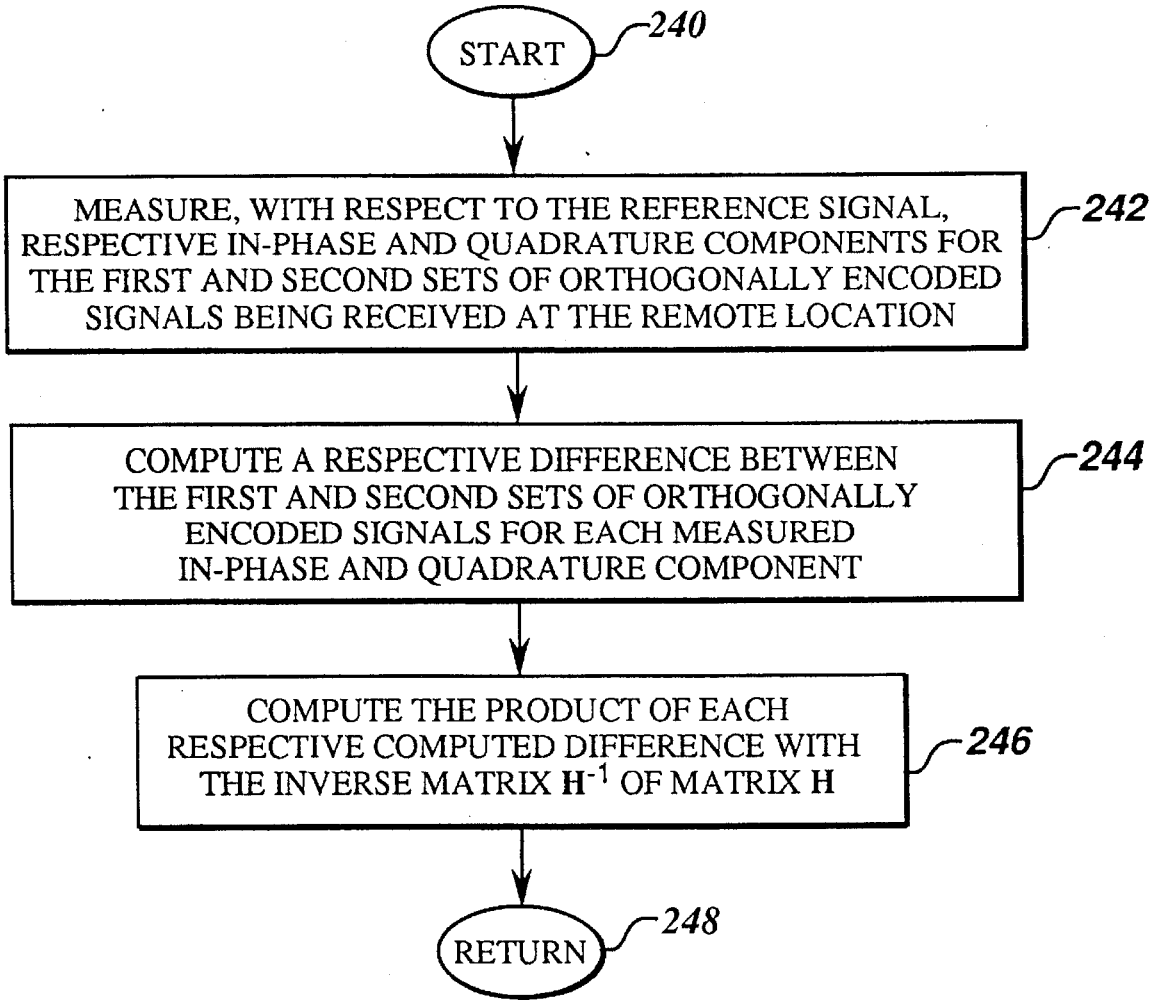
FIG. 9 is a flowchart showing steps used for measuring in-phase and quadrature components of orthogonally encoded signals and for decoding the measured in-phase and quadrature components of the orthogonally encoded signals.

FIG. 9 shows a flowchart that can be used for performing, respectively, detecting step 210 and decoding step 212 (FIG. 7). After start of operations in step 240, and assuming that the first and second sets of encoded signals are made up, respectively, of first and second sets of orthogonally encoded signals, step 242 allows for measuring, with respect to the reference signal, respective in-phase and quadrature components for the first and second sets of orthogonally encoded signals which are received at the remote location. For example, coherent detector 400 (FIG. 6) allows for measuring both in-phase components and quadrature components of any received encoded signals. This can further include measuring, with respect to the reference signal, the phase and amplitude for each first and second sets of orthogonally encoded signals which are received at the remote location. It will be appreciated that absolute measurements are not important since the calibration data can be effectively obtained from relative measurements of phase and amplitude, i.e., respective measurements of variation over time of phase and amplitude for each received encoded signal relative to the phase of the reference signal. Step 244 allows for computing a respective difference between each respective measured in-phase and quadrature components for the first and second sets of orthogonally encoded signals which are received at the remote location. Prior to end of operations in step 248, step 246 allows for computing the product of each respective computed difference with the inverse of the same binary orthogonal matrix, $H^{-1}=H^T/N$ used in the controlled switching encoding. In accordance with another advantage of the present invention, it will be appreciated that the computation of inverse matrix $H^{-1}$ is straightforward since the inverse matrix in this case is simply the transpose of H normalized by the factor 1/N.

Figure 10:
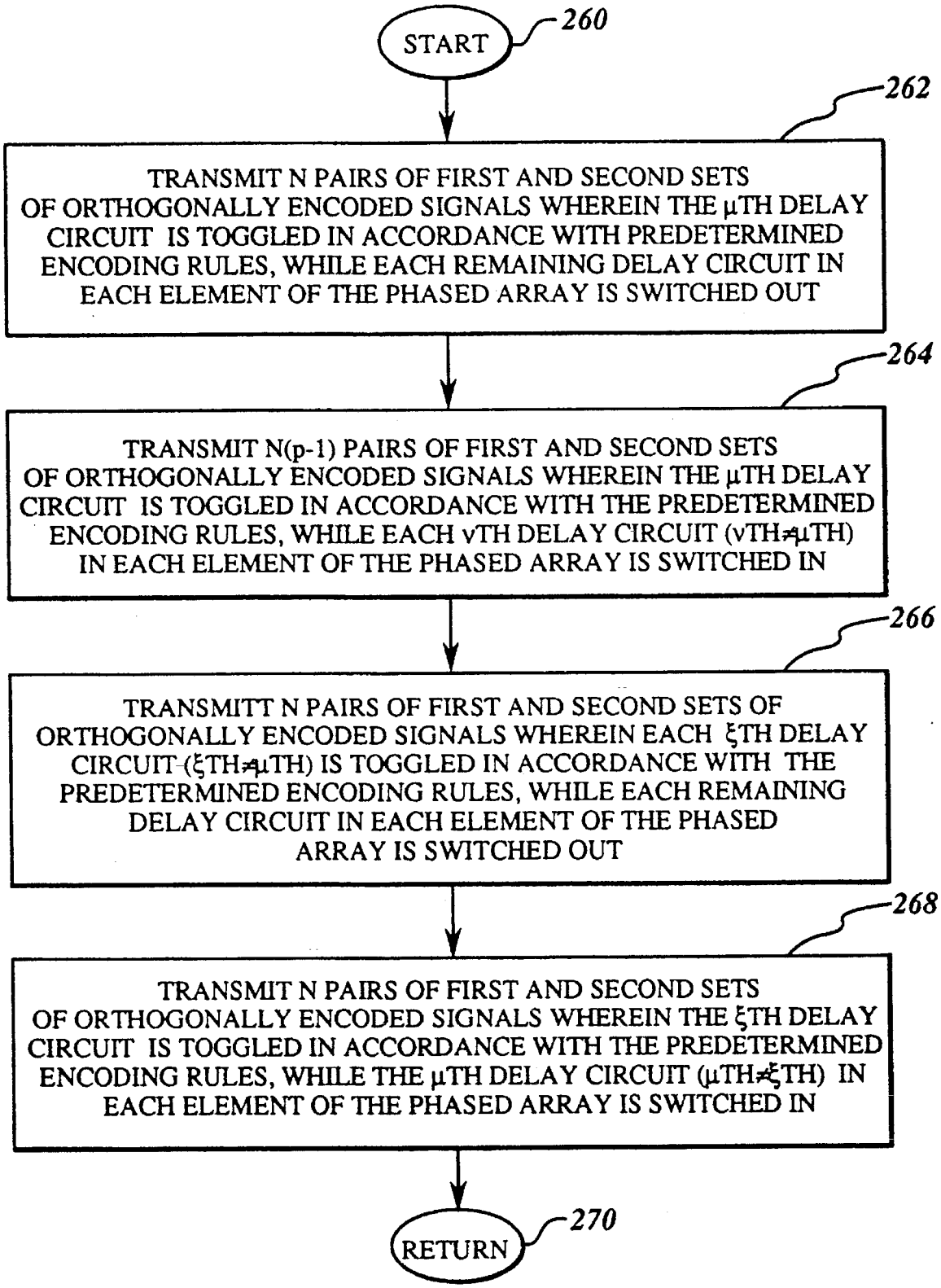
FIG. 10 is a flowchart showing steps for sequentially transmitting the orthogonally encoded signals used for calibrating the phased array system of FIG. 2.

FIG. 10 shows a flowchart which provides further details about transmitting step 208 (FIG. 7) which allows for calibrating the full set of N(p+1) state variables associated with, for example, the N elements for the phased array system of FIG. 2. It will be shown that the controlled switching calibration procedure in accordance with the present invention generally requires a total of 2N(p+2) individual sequential transmissions, or N(p+2) sequential transmission pairs, that is, sequentially transmitting N(p+2) pairs of the first and second sets of orthogonally encoded signals. This advantageously enables the calibration procedure in accordance with the present invention to provide information comparable to a SE calibration measurement at a signal-to-noise ratio (SNR) effectively enhanced by a factor $$\frac{(p+1)}{(p+2)}\ 2N$$

over the SE calibration measurement with the same maximum elemental signal power for each transmission.

After start of operations in step 260, step 262 allows for sequentially transmitting N pairs of orthogonally encoded signals, such as corresponding to the first and second sets of orthogonally encoded signals, wherein each μth delay circuit is switched in accordance with predetermined encoding rules based upon entries of matrix H, while each remaining delay circuit in each element of the phased array system is switched-out. Each sequentially received transmission pair is conveniently expressed in vector form as, $$Y_{\mu o} = [y_{\mu o}(1), y_{\mu o}(2), \ldots, y_{\mu o}(N)]^T; \quad (5)$$

$$Y^R_{\mu o} = [y^R_{\mu o}(1,) y^R_{\mu o}(2), \ldots, y^R_{\mu o}(N)]^T.$$

The first subscript index μ on $Y_{\mu 0}$ indicates that a predetermined delay circuit, such as the μth delay circuit, is toggled in accordance with predetermined encoding rules based upon entries of Hadamard matrix H. The second subscript (zero) on these vector signals indicates that these are the signals received when each remaining delay circuit, other than the μth delay circuit, is switched-out. For this step of the calibration process, N transmission pairs of orthogonally encoded signals corresponding to the N elements of the phased array system are sequentially transmitted and received at the remote location.

Any mth sequentially received transmission pair of the first and second sets of orthogonally encoded signals is, respectively, represented by, $$y_{\mu 0}(m) = \sum_{n=1}^{N} D_\mu(mn) s(n), \quad (6)$$

$$y^R_{\mu 0}(m) = \sum_{n=1}^{N} D_\mu{}^R(mn) s(n).$$

The encoding coefficients $D_\mu(mn)$, $D_\mu{}^R(mn)$ are dictated by the status of the delay circuits that are switched according to the following Hadamard encoding rules:

$$D_\mu(mn) = \begin{cases} +1 & \text{μth delay circ. of nth element switched out if } H(mn) = +1 \\ d_\mu(n) & \text{μth delay circ. of nth element switched in if } H(mn) = -1 \end{cases}; \quad (7)$$

$$D_\mu{}^R(mn) = \begin{cases} +1 & \text{μth delay circ. of nth element switched out if } H(mn) = -1 \\ d_\mu(n) & \text{μth delay circ. of nth element switched in if } H(mn) = +1 \end{cases}.$$

The differences of the encoding matrices are represented in component and matrix form as, $$D_\mu(mn) - D_\mu{}^R(mn) = H(mn)(1 - d_\mu(n)); \; D_\mu - D_\mu{}^R = H(I - d_\mu). \quad (8)$$

As suggested above, decoding can be conveniently performed at the remote location by computing the difference of received signal vectors $Y_{\mu 0}$, $Y_{\mu 0}{}^R$ and multiplying the resulting vector difference by the inverse of the same Hadamard matrix that was used in the controlled switching performed onboard the satellite. In the absence of noise, we obtain a decoded vector signal $Z_{\mu 0}$, such that, $$Z_{\mu 0} \equiv H^{-1}(Y_{\mu 0} - Y_{\mu 0}{}^R) = H^{-1}(D_\mu - D_\mu{}^R)\, S = (I - d_\mu) S. \quad (9)$$

Step 264 allows for transmitting N(p−1) pairs of orthogonally encoded signals wherein each μth delay circuit is toggled in accordance with the predetermined encoding rules while another predetermined delay circuit other than the μth delay circuit, say the vth delay circuit, is permanently switched-in on each of the elements of the phased array. In this case, any mth received transmission pair of the first and second sets of orthogonally encoded signals is represented, respectively, by $$y_{\mu\nu}(m) = \sum_{n=1}^{N} D_\mu(mn) d_\nu(n) s(n), \quad (10)$$

$$y^R_{\mu\nu}(m) = \sum_{n=1}^{N} D_\mu{}^R(mn) d_\nu(n) s(n).$$

Here again, the first subscript index μ on any component $y_{\mu\nu}$ indicates that the gth delay circuit is toggled in accordance with the predetermined encoding rules based upon entries of the predetermined Hadamard matrix H while the second subscript index (here the ν index) indicates that the vth delay circuit is switched-in on each of the elements of the phased array system. In this case the resulting set of decoded signals are represented in vector form by a decoded vector $Z_{\mu\nu}$, such that $$Z_{\mu\nu} \equiv H^{-1}(Y_{\mu\nu} - Y_{\mu\nu}{}^R) = H^{-1}(D_\mu - D_\mu{}^R) S = (I - d_\mu) d_\nu S. \quad (11)$$

The N complex gains, $d_\nu(n)$ are readily computed by taking the ratio of the decoded vector signal components, $$d_\nu(n) = [z_{\mu\nu}(n) / z_{\mu 0}(n)] \quad (12)$$

The above-described procedure can be repeated using controlled switching with the predetermined μth delay circuit and with each of the other remaining delay circuits singly switched-in to determine each complex gain, $d_\nu(n)$ for all (p−1) remaining delay circuits such that ν≠μ. In this manner, step 264 allows for transmitting N(p−1) pairs of first and second sets of orthogonally encoded signals wherein the predetermined μth delay circuit is toggled in accordance with the predetermined encoding rules, while each remaining vth delay circuit in each phase-shifting element of the phased array is sequentially switched-in.

Step 266 allows for transmitting N pairs of first and second sets of orthogonally encoded signals wherein any delay circuit other than the μth delay circuit, for example the ξth delay circuit (ξth ≠μth), is toggled in accordance with the predetermined encoding rules, while each remaining delay circuit in each element of the phased array system is switched out. In this case, the resulting set of decoded signals are represented in vector form by decoded vector signal $Z_{\xi 0}$, such that $$Z_{\xi o} = (I - d_\xi) S. \quad (13)$$

Step 268 allows for transmitting N pairs of first and second sets of orthogonally encoded signals wherein the ξth delay circuit is toggled in accordance with the predetermined encoding rules, while the predetermined μth delay circuit in each phase shifter of the phased array system is switched in. In this case the resulting set of decoded signals are represented in vector form by decoded vector signal $Z_{\xi\mu}$ such that $$Z_{\xi\mu} = (I - d_\xi) d_\mu S. \quad (14)$$

The N complex gains $d_\mu(n)$ are readily computed by taking the ratio of the decoded vector signal components, $$d_\mu(n)=[z_{\xi\mu}(n)/z_{\xi 0}(n)]. \quad (15)$$

Once all the respective complex gains $d_\gamma(n)$ are determined for all $\gamma=1, 2, \ldots, p$; $n=1, 2, \ldots, N$, the "straight-through" signals or undelayed signals, $\{s(n)\}$, are readily determined from, $$s(n)=[z_{\mu 0}(n)]/[1-d_\mu(n)]. \quad (16)$$

Thus the complete calibration data for each respective complex gain for N×p delay circuits plus the complex gains for the N straight-through or undelayed electrical paths are obtained with N(p+2) transmission pairs that can be conveniently enumerated as follows:

| Switching Action | Measured Result | Transmission Pairs Number |
|---|---|---|
| μth delay unit switched as per H(mn) entries; all other delay units switched-out | $(I - d_\mu)S$ | N |
| μth delay unit switched as per H(mn) entries; each remaining delay unit vth ≠ μth being sequentially switched-i89= | $(I - d_\mu)d_\nu S$ | N (p − 1) |
| ξth delay unit (ξth ≠ μth) switched as per H(mn) entries; all other delay units switched-out | $(I = d_\xi)S$ | N |
| ξth delay unit switched as per H(mn) entries; μth delay unit switched-in | $(I - d_\xi)d_\mu S$ | N |

Mathematics of Hadamard Control Matrices

An Nth order Hadamard matrix 2 is an N×N binary orthogonal matrix with each entry, $[H]_{mn}=H(mn)$ equal either to ±1. An Nth order Hadamard matrix is not unique, as any permutation of the rows or columns also produces an additional Nth order Hadamard matrix. Hadamard matrices are orthogonal matrices with inverses, $H^{-1}=H^T/N$. As an example, we illustrate the recursive generation of the set of radix 2 natural form Hadamard matrices. Consider a fundamental matrix of order N=2.

$$H_2=\begin{bmatrix} +1 & +1 \\ +1 & -1 \end{bmatrix}. \quad (17)$$

An N=4th order natural form Hadamard matrix can be constructed as:

$$H_4=\begin{bmatrix} H_2 & H_2 \\ H_2 & -H_2 \end{bmatrix}=\begin{bmatrix} +1 & +1 & +1 & +1 \\ +1 & -1 & +1 & -1 \\ +1 & +1 & -1 & -1 \\ +1 & -1 & -1 & +1 \end{bmatrix}. \quad (18)$$

The "natural form" Hadamard matrix of order 2N can be constructed from the Nth order Hadamard matrix using, $$H_{2N}=\begin{bmatrix} H_N & H_N \\ H_N & -H_N \end{bmatrix} \quad (19)$$

The orthogonal encoding using a Hadamard control matrix is based upon the following procedure. Consider a diagonal matrix d of complex numbers, $d\equiv diag[d(1),d(2), \ldots d(N)]$. Construct matrices, $D,D^R$, based upon any suitable Hadamard matrix with their (mn)th matrix elements or entries constructed according to the following rules:

$$D(mn)=\begin{cases} +1 & \text{if } H(mn)=+1 \\ d(n) & \text{if } H(mn)=-1 \end{cases}; \quad (20)$$

$$D^R(mn)=\begin{cases} d(n) & \text{if } H(mn)=+1 \\ +1 & \text{if } H(mn)=-1 \end{cases}.$$

Matrices of the differences of $D,D^R$ are expressed in component and matrix form as, $$D(mn)-D^R(mn)=H(mn)(1-d(n);\ D-D^R=H(I-d) \quad (21)$$

Here I is the identity matrix. Multiplying each side of Eq. (21) by the inverse matrix $H^{-1}$, gives a diagonal matrix, $$H^{-1}(D-D^R)=H^{-1}H(I-d)=I-d. \quad (22)$$

While only certain features of the invention have been illustrated and described herein, many modifications, substitutions, changes, and equivalents will now occur to those skilled in the art. For example, although the above-described mathematical background illustrates use of Hadamard matrixes in their "natural form", it will be understood that the orthogonal encoding can be performed using all forms of Hadamard matrixes and thus the present invention is not limited to "natural form" Hadamard matrixes. It is, therefore, to be understood that the appended claims are intended to cover all such modifications and changes as fall within the true spirit of the invention.

What is claimed is:

1. A method for remotely calibrating a system having a plurality of N elements, N being a positive integer number, said method comprising the steps of:

coherently generating a calibration signal and a reference signal having a predetermined spectral relationship between one another;

applying to each respective one of said plurality of N elements the calibration signal;

encoding the calibration signal applied to each respective one of said plurality of N elements to generate first and second sets of encoded signals;

transmitting the first and second sets of encoded signals and the reference signal to a remote location;

coherently detecting the transmitted first and second sets of encoded signals at the remote location;

decoding the coherently detected first and second sets of encoded signals to generate a set of decoded signals; and processing the set of decoded signals for generating calibration data for each element of said system.

2. The method of claim 1 wherein said system comprises a phased array system.

3. The method of claim 2 wherein each of said N elements in said phased array system includes a plurality of p delay circuits.

4. The method of claim 3 wherein said encoding step comprises:

generating a first set of calibration switching signals based upon entries of a predetermined invertible matrix H;

applying the first set of calibration switching signals to actuate respective ones of the p delay circuits in each of the N elements so as to generate the first set of encoded signals;

generating a second set of calibration switching signals based upon entries of another invertible matrix defined by the product of (−1)H; and applying the second set of calibration switching signals to actuate respective ones of the p delay circuits in each of the N elements so as to generate the second set of encoded signals.

5. The method of claim 4 wherein said invertible matrix H comprises a binary matrix having at least a size N×N.

6. The method of claim 5 wherein said binary matrix comprises a Hadamard matrix.

7. The method of claim 6 wherein said first and second sets of encoded signals comprise, respectively, first and second sets of orthogonally encoded signals.

8. The method of claim 7 wherein said coherently detecting step comprises measuring, with respect to said reference signal, respective in-phase and quadrature components for the first and second sets of orthogonally encoded signals being received at the remote location.

9. The method of claim 5 wherein said decoding step comprises:

computing a respective difference between each respective measured in-phase and quadrature components for the first and second sets of encoded signals being received at the remote location; and computing the product of each respective computed difference with the inverse matrix $H^{-1}$ of matrix H.

10. The method of claim 8 wherein said measuring step comprises measuring, with respect to said reference signal, phase and amplitude of the first and second sets of orthogonally encoded signals being received at the remote location.

11. The method of claim 7 wherein said transmitting step comprises transmitting a total of N(p+2) pairs of the first and second sets of orthogonally encoded signals.

12. The method of claim 11 wherein N pairs of the total of N(p+2) transmitted pairs of the first and second sets of orthogonally encoded signals comprise respective pairs wherein a predetermined μth delay circuit in each element of the phased array system is toggled in accordance with predetermined encoding rules based upon entries of a Hadamard matrix, while each remaining delay circuit in each element of the phased array system is switched-out.

13. The method of claim 11 wherein N(p−1) pairs of the total of N(p+2) transmitted pairs of the first and second sets of orthogonally encoded signals comprise respective pairs wherein the μth delay circuit in each element of the phased array system is toggled in accordance with the predetermined encoding rules while each remaining νth circuit, other than the μth delay circuit which is being toggled in accordance with the encoding rules, in each element of the phased array system is sequentially switched-in.

14. The method of claim 11 wherein N pairs of the total of N(p+2) transmitted pairs of the first and second sets of orthogonally encoded signals comprise respective pairs wherein another predetermined ξth delay circuit, other than the μth delay circuit, in each element of the phased array system is toggled in accordance with the predetermined encoding rules while each remaining delay circuit in each element of the phased array system is switched-out.

15. The method of claim 11 wherein N pairs of the total of N(p+2) transmitted pairs of the first and second sets of orthogonally encoded signals comprise respective pairs wherein the another predetermined ξth delay circuit in each element of the phased array system is toggled in accordance with the predetermined encoding rules while the μth circuit in each element of the phased array system is switched-in.

16. Apparatus for remotely calibrating a system having a plurality of N elements, N being a positive integer number, said apparatus comprising:

a coherent signal generator for generating a calibration signal and a reference signal having a predetermined spectral relationship between one another;

means for applying to each respective one of said plurality of N elements the calibration signal;

means for encoding the calibration signal applied to each respective one of said plurality of N elements to generate first and second sets of encoded signals;

means for transmitting the first and second sets of encoded signals and the reference signal to a remote location;

a coherent detector for detecting the transmitted first and second sets of encoded signals at the remote location;

means for decoding the coherently detected first and second sets of encoded signals to generate a set of decoded signals; and a processor adapted to process the set of decoded signals for generating calibration data for each element of said system.

17. The apparatus of claim 16 wherein said system comprises a phased array system.

18. The apparatus of claim 17 wherein each of said N elements in said phased array system includes a plurality of p delay circuits.

19. The apparatus of claim 18 wherein said means for encoding comprises:

means for generating a first set of calibration switching signals based upon entries of a predetermined invertible matrix H;

means for applying the first set of calibration switching signals to actuate respective ones of the p delay circuits in each of the N elements so as to generate the first set of encoded signals;

means for generating a second set of calibration switching signals based upon entries of another invertible matrix defined by the product of (−1)H; and means for applying the second set of calibration switching signals to actuate respective ones of the p delay circuits in each of the N elements so as to generate the second set of encoded signals.

20. The apparatus of claim 19 wherein said invertible matrix H comprises a binary matrix having at least a size N×N.

21. The apparatus of claim 20 wherein said binary matrix comprises a Hadamard matrix.

22. The apparatus of claim 21 wherein said first and second sets of encoded signals comprise, respectively, first and second sets of orthogonally encoded signals.

23. The apparatus of claim 21 wherein said coherent detector comprises means for measuring, with respect to said reference signal, respective in-phase and quadrature components for the first and second sets of orthogonally encoded signals being received at the remote location.

24. The apparatus of claim 20 wherein said means for decoding comprises:

means for computing a respective difference between each respective measured in-phase and quadrature components for the first and second sets of encoded signals being received at the remote location; and means for computing the product of each respective computed difference with the inverse matrix $H^{-1}$ of matrix H.

25. The apparatus of claim 23 wherein said means for measuring respective in-phase and quadrature components for the first and second sets of orthogonally encoded signals comprises means for measuring, with respect to said reference signal, phase and amplitude of the first and second sets of orthogonally encoded signals being received at the remote location.

26. The apparatus of claim 22 wherein said means for transmitting in operation transmits a total of N(p+2) pairs of the first and second sets of orthogonally encoded signals.

27. The apparatus of claim 26 wherein N pairs of the total of N(p+2) transmitted pairs of the first and second sets of orthogonally encoded signals comprise respective pairs wherein a predetermined μth delay circuit in each element of the phased array system is toggled in accordance with predetermined encoding rules based upon entries of a Hadamard matrix, while each remaining delay circuit in each element of the phased array system is switched-out.

28. The apparatus of claim 26 wherein N(p−1) pairs of the total of N(p+2) transmitted pairs of the first and second sets of orthogonally encoded signals comprise respective pairs wherein the μth delay circuit in each element of the phased array system is toggled in accordance with the predetermined encoding rules while each remaining νth circuit, other than the μth delay circuit which is being toggled in accordance with the encoding rules, in each element of the phased array system is sequentially switched-in.

29. The apparatus of claim 26 wherein N pairs of the total of N(p+2) transmitted pairs of the first and second sets of orthogonally encoded signals comprise respective pairs wherein another predetermined ξth delay circuit, other than the μth delay circuit, in each element of the phased array system is toggled in accordance with the predetermined encoding rules while each remaining delay circuit in each element of the phased array system is switched-out.

30. The apparatus of claim 26 wherein N pairs of the total of N(p+2) transmitted pairs of the first and second sets of orthogonally encoded signals comprise respective pairs wherein the another predetermined ξth delay circuit in each element of the phased array system is toggled in accordance with the predetermined encoding rules while the μth circuit in each element of the phased array system is switched-in.

* * * * *